US007175357B1

(12) United States Patent
Brignoni

(10) Patent No.: US 7,175,357 B1
(45) Date of Patent: Feb. 13, 2007

(54) PERSONAL BACKSCRUB

(76) Inventor: Iris N. Brignoni, P.O. Box 451382, Kissimmee, FL (US) 34745

( * ) Notice: Subject to any disclaimer, the term of this patent is extended or adjusted under 35 U.S.C. 154(b) by 0 days.

(21) Appl. No.: 11/444,211

(22) Filed: May 30, 2006

(51) Int. Cl.
*A46B 11/00* (2006.01)

(52) U.S. Cl. ..... 401/28; 4/606

(58) Field of Classification Search ..... 401/24, 401/28, 39, 272, 278, 279, 281, 282, 287; 4/606; 15/88.2–88.3
See application file for complete search history.

(56) References Cited

U.S. PATENT DOCUMENTS 4,704,756 A 11/1987 Williams et al.
4,943,018 A 7/1990 Glaser et al.
5,345,640 A 9/1994 Goss
5,561,869 A 10/1996 Sarel
5,600,864 A 2/1997 Huber
5,779,653 A 7/1998 Thompson
6,996,861 B1 * 2/2006 Clark, Jr. ..... 4/606

* cited by examiner

*Primary Examiner*—Huyen Le

(57) ABSTRACT

A back scrubber is used in the shower and includes a multiplicity of brushes and a flexible soap dispensing container mounted on a flexible body. Suction cups are also mounted on the flexible body to fix the back scrubber to a wall. When pressure is applied to the brushes, a motor unit is activated to rotate the brushes. The same pressure will cause soap to be dispensed from the soap dispensing container.

2 Claims, 1 Drawing Sheet

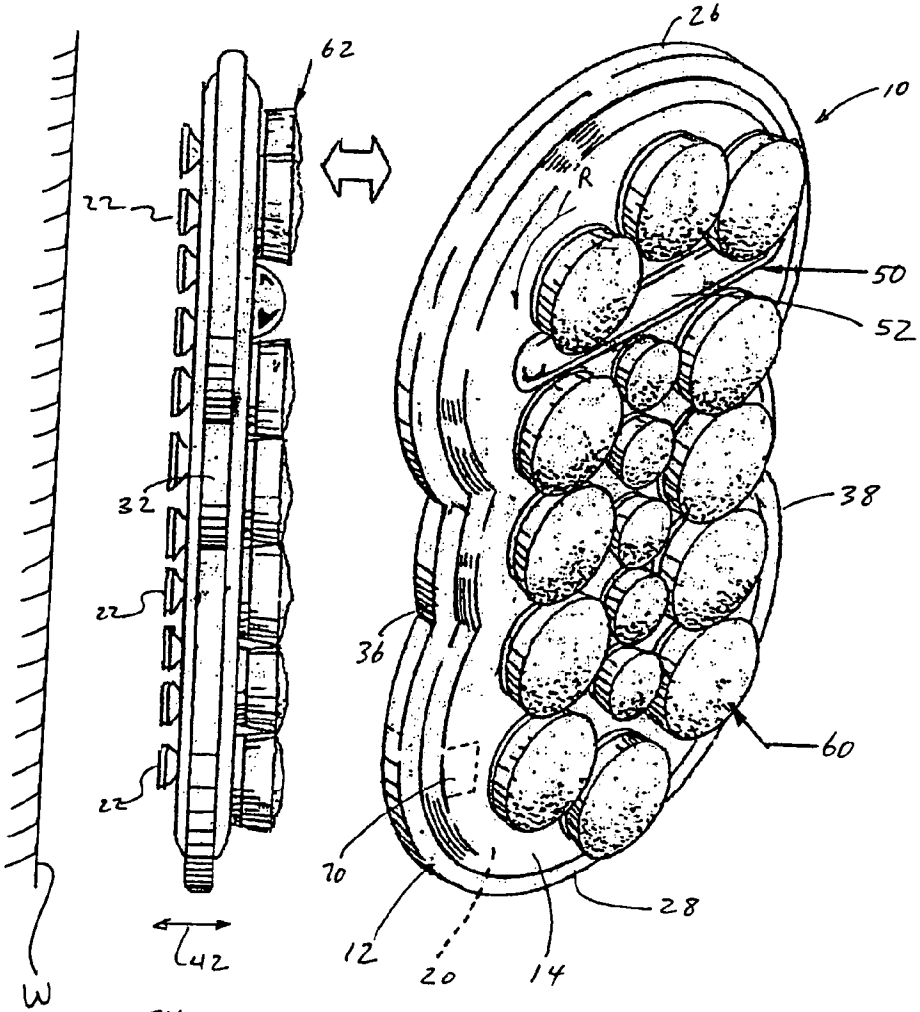
FIG. 3
FIG. 2
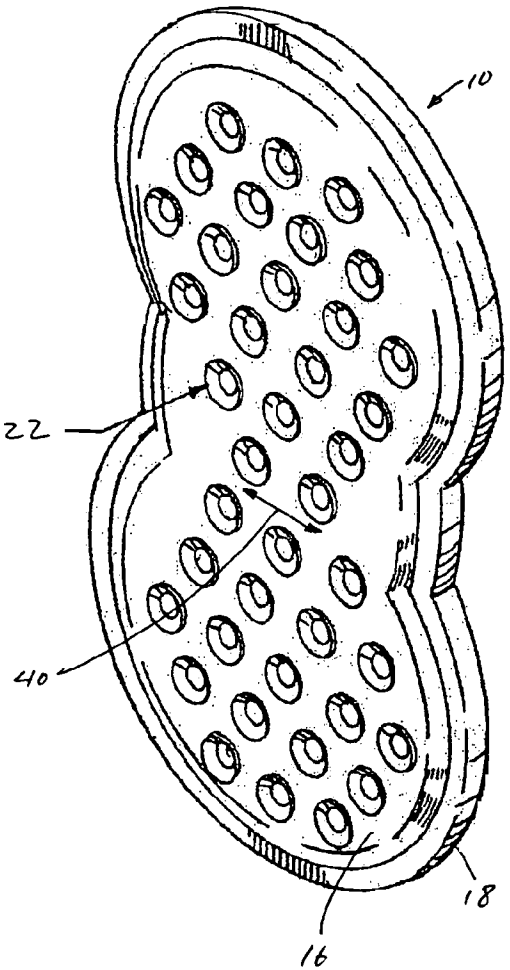
FIG. 1

PERSONAL BACKSCRUB

TECHNICAL FIELD OF THE INVENTION

The present invention relates to the general art of baths and showers, and to the particular field of bathing accessories.

BACKGROUND OF THE INVENTION

When a person takes a shower, he or she has a problem of cleansing and soap scrubbing his or her back. Properly scrubbing a person's back during a shower is a difficult operation to perform alone. Even people with normal degrees of joint articulation find it hard to reach all of the areas of the back. However this is even more difficult for people with arthritis or other disabilities limiting arm movement. Some people use a back scrubber made of sponge with wooden or plastic handle or a backing with luffa or sponge pads with looped hand-pulls or just a small hand towel to soap scrub their back. It is hard work and very inefficient. In some cases, the person may even be subject to pulling a muscle.

Back brushes generally have taken the form of a brush with a long handle in which the user can reach around and scrub his or her own back. Back brushes with both fixed and detachable handles have been available heretofore. Although such back brushes have been generally satisfactory, they have not been without some drawbacks due to their manner of use. It will be appreciated that a fair amount of physical flexibility and coordination is required for their effective use. People with stiff necks, backs, shoulders or other joints may not be able to use such back brushes, or if so only with difficulty. Moreover, the typical back brush of the prior art is relatively small and flat and is only suited for relatively localized scrubbing over a limited area with limited pressure.

Therefore, there is a need for a means for scrubbing one's back in a manner that does not require contortions and can be easily used by one who does not have great manual dexterity.

SUMMARY OF THE INVENTION

The above-discussed disadvantages of the prior art are overcome by a back scrubber which comprises a flexible body having a first surface that is a front surface when the body is in use, and a second surface that is a rear surface when the body is in use. The front surface is spaced apart from the rear surface to define an interior volume in the flexible body. A multiplicity of suction cups are located on the rear surface of the body for attaching the flexible body to the wall of a shower. A flexible container is located on the front surface of the body and has a plurality of dispensing holes defined therein. The flexible container is adapted to contain liquid soap on the front surface and to dispense liquid soap through the dispensing holes when pressure is applied to the container. A multiplicity of brushes are rotatably mounted on the front surface. The brushes are movable toward the rear surface between a first position with the front surface unflexed and a second position with the front surface flexed toward the rear surface. A motor unit is located in the flexible body and is operatively connected to the brushes to rotate those brushes when the brushes are moved toward the rear surface into the second position thereof.

Using the back scrubber embodying the present invention will permit a user to easily scrub his or her back in a comfortable manner.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 1 is a rear perspective view of a back scrubber embodying the present invention.

FIG. 2 is a side elevational view of the back scrubber shown in FIG. 1.

FIG. 3 is a front perspective view of a back scrubber embodying the present invention.

DETAILED DESCRIPTION OF THE INVENTION

Referring to the figures, it can be understood that the present invention is embodied in a back scrubber 10 embodying the present invention. Back scrubber 10 comprises a flexible body 12 which has a first surface 14 that is a front surface when the body is in use on a wall W of a shower or the like. A second surface 16 is a rear surface when the body is in use. Body 12 further includes a peripheral edge 18.

The front surface is spaced apart from the rear surface to define an interior volume 20 in the flexible body. A multiplicity of suction cups, such as suction cup 22, are located on the rear surface of the body and operate to releasably mount the body on a wall W.

Body 12 further includes a first end 26 which is a top end when the body is in use, a second end 28 which is a bottom end when the body is in use and a longitudinal axis 32 which extends between first end 26 and second end 28 of the body. Body 12 also includes a first side 36 which extends between the first end and the second end of the body, a second side 38 which extends between the first end and the second end of the body and a transverse axis 40 which extends between the first side and the second side of the body. Body 12 includes a thickness dimension 42 which extends between the front surface and the rear surface.

A flexible container 50 is located on front surface 14 of the body. Flexible container 50 has a plurality of dispensing holes, such as dispensing hole 52, defined therein. The flexible container is located near the top end of the body and extends transversely across the front surface in the direction of the transverse axis of the body so it will be in the most advantageous position and location to dispense soap that is most likely to cover a user's back and flow down that user's back during use of the soap dispenser. The flexible container is adapted to contain liquid soap on the front surface and will dispense liquid soap through the dispensing holes when pressure is applied to the container.

Multiple brushes, such as brush 60, are rotatably mounted on the front surface of the body. Flexible container 50 is located between some of the brushes. The brushes are movable toward the rear surface between a first position with the front surface inflexed as indicated in FIG. 2, and a second position with the front surface flexed toward the rear surface as indicated in dotted lines for brush 62 in FIG. 2. Movement of the brushes is indicated by the double-headed arrow in FIG. 2 and rotation of the brushes is indicated by arrow R in FIG. 3.

A motor unit 70 is located in the interior volume of the flexible body. The motor unit is operatively connected to the brushes to rotate those brushes when the brushes are moved toward the rear surface into the second position thereof. Motor unit 70 can be a single motor connected to all of the brushes or a plurality of motors that are connected together with each motor being associated with one or more brushes. Access to the motor unit and the power unit associated therewith is gained by opening the flexible body. Accordingly, the front surface of the flexible body is releasably attached to the sides and to the rear surface so the front surface can be removed from the rest of the flexible body.

The details of the operative connection between the motor unit and the brushes, as well as the details of the motor unit, itself, are not important to this invention and such details will not be claimed. Those skilled in the art will be able to understand what elements are required to achieve the desired results based on their own knowledge and disclosures in the art such as U.S. Pat. No. 5,345,640, the disclosure of which is incorporated herein by reference. Accordingly, such details will not be discussed but will be understood by those skilled in the art based on the teaching of the present disclosure.

Use of back scrubber 10 will be understood from the teaching of the present disclosure and thus will be only briefly discussed. The flexible body is placed on the wall of a shower in a desired location and is held in place by the suction cups. Power is applied to the motor unit, either from an enclosed battery pack or the like, and a user forces his or her back against the brushes. As the user presses his or her back against the brushes, those brushes move into a position to activate the motor to rotate the brushes. Also, the rearward movement of the user's back toward the rear surface of the flexible body will apply pressure to the liquid soap container and cause soap to be dispensed onto the user's back. Operation of the brushes will also massage a user. It is also noted that while a user's back is described herein, the user can also activate and use the scrubber 10 on any other part of his or her body by simply pressing on the brushes and the soap dispenser to force those elements back toward the rear surface of the flexible body.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A back scrubber comprising:

A) a flexible body having (1) a first surface that is a front surface when the body is in use, (2) a second surface that is a rear surface when the body is in use, (3) a peripheral edge, (4) the front surface being spaced apart from the rear surface to define an interior volume in the flexible body, (5) a multiplicity of suction cups on the rear surface of the body, (6) a first end which is a top end when the body is in use, (7) a second end which is a bottom end when the body is in use, (8) a longitudinal axis which extends between the first end and the second end of the body, (9) a first side which extends between the first end and the second end of the body,

(10) a second side which extends between the first end and the second end of the body,

(11) a transverse axis which extends between the first side and the second side of the body, and

(12) a thickness dimension which extends between the front surface and the rear surface;

B) a flexible container on the front surface of the body, the flexible container having a plurality of dispensing holes defined therein, the flexible container being located near the top end of the flexible body and extending transversely across the front surface in the direction of the transverse axis of the body, the flexible container being adapted to contain liquid soap on the front surface and to dispense liquid soap through the dispensing holes when pressure is applied to the container;

C) a multiplicity of brushes rotatably mounted on the front surface, the flexible container being located between some of the brushes, the brushes being movable toward the rear surface between a first position with the front surface unflexed and a second position with the front surface flexed toward the rear surface; and D) a motor unit located in the interior volume of the flexible body, the motor unit being operatively connected to the brushes to rotate those brushes when the brushes are moved toward the rear surface into the second position thereof.

2. A back scrubber comprising:

A) a flexible body having (1) a first surface that is a front surface when the body is in use, (2) a second surface that is a rear surface when the body is in use, the front surface being spaced apart from the rear surface to define an interior volume in the flexible body, and (3) a multiplicity of suction cups on the rear surface of the body;

B) a flexible container on the front surface of the body, the flexible container having a plurality of dispensing holes defined therein, the flexible container being adapted to contain liquid soap on the front surface and to dispense liquid soap through the dispensing holes when pressure is applied to the container;

C) a multiplicity of brushes rotatably mounted on the front surface, the brushes being movable toward the rear surface between a first position with the front surface unflexed and a second position with the front surface flexed toward the rear surface; and D) a motor unit located in the flexible body, the motor unit being operatively connected to the brushes to rotate those brushes when the brushes are moved toward the rear surface into the second position thereof.

* * * * *